US009353640B2

(12) United States Patent
Kuwamura et al.

(10) Patent No.: US 9,353,640 B2
(45) Date of Patent: May 31, 2016

(54) TURBINE

(75) Inventors: Yoshihiro Kuwamura, Tokyo (JP); Kazuyuki Matsumoto, Tokyo (JP); Hiroharu Oyama, Tokyo (JP); Yoshinori Tanaka, Tokyo (JP); Asaharu Matsuo, Kobe (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 420 days.

(21) Appl. No.: 13/995,542

(22) PCT Filed: Dec. 22, 2011

(86) PCT No.: PCT/JP2011/079808

§ 371 (c)(1),
(2), (4) Date: Jun. 19, 2013

(87) PCT Pub. No.: WO2012/086757

PCT Pub. Date: Jun. 28, 2012

(65) Prior Publication Data

US 2013/0272855 A1 Oct. 17, 2013

(30) Foreign Application Priority Data

Dec. 22, 2010 (JP) ..... 2010-286583

(51) Int. Cl.
*F01D 11/08* (2006.01)
*F01D 11/04* (2006.01)
(Continued)

(52) U.S. Cl.
CPC ..... *F01D 11/04* (2013.01); *F01D 5/225* (2013.01); *F01D 11/10* (2013.01); *F05D 2250/294* (2013.01)

(58) Field of Classification Search
CPC ..... F01D 11/00; F01D 11/001; F01D 11/02; F01D 11/04; F01D 11/08; F01D 11/10; F16J 15/447; F16J 15/4472
USPC ..... 415/173.5, 173.6, 174.5
See application file for complete search history.

(56) References Cited

U.S. PATENT DOCUMENTS 3,897,169 A * 7/1975 Fowler ..... F01D 11/08 277/419
4,295,787 A 10/1981 Lardellier
(Continued)

FOREIGN PATENT DOCUMENTS

CN 2725533 9/2005
EP 1 001 139 5/2000
(Continued)

OTHER PUBLICATIONS

Chinese Office Action issued Aug. 5, 2014 in corresponding Chinese Patent Application No. 201180056739.9 with English translation.
(Continued)

*Primary Examiner* — Richard Edgar
(74) *Attorney, Agent, or Firm* — Wenderoth, Lind & Ponack, L.L.P.

(57) ABSTRACT

A turbine includes a blade, a structure installed at a tip section side of the blade via a gap and configured to relatively rotate with respect to the blade, a step section formed at the tip section of the blade, having at least one step surface, and protruding toward a portion opposite to the tip section of the structure, a seal fin formed at the portion opposite to the tip section of the structure, extending toward the step section, and configured to form a micro gap between the step section and the seal fin, and a cutout section formed at the step surface to be connected to an upper surface of the step section. The cutout section guides a separation vortex separated from a main stream of a fluid passing through the gap toward the seal fin on the upper surface of the step section.

2 Claims, 7 Drawing Sheets

(51) Int. Cl.
*F01D 11/10* (2006.01)
*F01D 5/22* (2006.01)

(56) References Cited

U.S. PATENT DOCUMENTS

| | | | |
|---|---|---|---|
| 4,662,820 | A | 5/1987 | Sasada et al. |
| 6,340,284 | B1 | 1/2002 | Beeck et al. |
| 2009/0072487 | A1 | 3/2009 | Chougule et al. |
| 2011/0156359 | A1 | 6/2011 | Zheng et al. |

FOREIGN PATENT DOCUMENTS

| | | |
|---|---|---|
| EP | 1 013 884 | 6/2000 |
| EP | 2 390 466 | 11/2011 |
| EP | 2 623 722 | 8/2013 |
| JP | 53-104803 | 8/1978 |
| JP | 59-51104 | 3/1984 |
| JP | 61-134501 | 8/1986 |
| JP | 63-61501 | 4/1988 |
| JP | 4-35601 | 6/1992 |
| JP | 4-350302 | 12/1992 |
| JP | 9-13905 | 1/1997 |
| JP | 10-311205 | 11/1998 |
| JP | 11-148307 | 6/1999 |
| JP | 11-148308 | 6/1999 |
| JP | 11-200810 | 7/1999 |
| JP | 2002-228014 | 8/2002 |
| JP | 2004-332616 | 11/2004 |
| JP | 2006-291967 | 10/2006 |
| JP | 2009-47043 | 3/2009 |
| JP | 2010-216321 | 9/2010 |
| JP | 2011-80452 | 4/2011 |
| JP | 2011-208602 | 10/2011 |
| WO | 2011/029420 | 3/2011 |
| WO | 2011/054341 | 5/2011 |

OTHER PUBLICATIONS

International Search Report issued Dec. 28, 2010 in International (PCT) Application No. PCT/JP2010/067350 w/English translation.
Written Opinion of the International Searching Authority issued Dec. 28, 2010 in International (PCT) Application No. PCT/JP2010/067350 w/English translation.
International Search Report issued Apr. 5, 2011 in International (PCT) Application No. PCT/JP2011/051895 w/English translation.
Written Opinion of the International Searching Authority issued Apr. 5, 2011 in International (PCT) Application No. PCT/JP2011/051895 w/English translation.
International Search Report issued Feb. 7, 2012 in International (PCT) Application No. PCT/JP2011/079808 w/English translation.
Written Opinion of the International Searching Authority issued Feb. 7, 2012 in International (PCT) Application No. PCT/JP2011/079808 w/English translation.
Chinese Office Action issued Nov. 18, 2013 in Chinese Patent Application No. 201080023193.2 with English translation.
Extended European Search Report issued May 9, 2014 in corresponding European Application No. 11851503.0.

* cited by examiner

TURBINE

TECHNICAL FIELD

The present invention relates to a turbine used in, for example, a power plant, a chemical plant, a gas plant, a steelworks, a ship, or the like.

Priority is claimed on Japanese Patent Application No. 2010-286583, filed Dec. 22, 2010, the content of which is incorporated herein by reference.

BACKGROUND ART

In the related art, a kind of steam turbine is known to include a plurality of stages each including a casing, a shaft body (a rotor) rotatably installed in the casing, turbine vanes fixedly disposed at an inner circumferential section of the casing, and turbine blades radially installed at the shaft body at a downstream side of the turbine vanes. In such a steam turbine, an impulse turbine converts pressure energy of steam into velocity energy by the turbine vanes, and converts the velocity energy into rotational energy (mechanical energy) by the turbine blades. In addition, in the steam turbine, a reaction turbine converts pressure energy into velocity energy also in the turbine blades, and converts the velocity energy into rotational energy (mechanical energy) by a reaction force applied by the steam burst.

In many cases of this kind of steam turbine, a gap in a radial direction is formed between tip sections of the turbine blades and the casing surrounding the turbine blades to form a flow path of the steam, and a gap in the radial direction is also formed between tip sections of the turbine vanes and the shaft body.

However, leaked steam passing through the gap of the turbine blade tip section toward a downstream side does not apply a rotational force to the turbine blades. In addition, since the leaked steam passing through the gap of the turbine vane tip section toward the downstream side does not convert the pressure energy into the velocity energy by the turbine vanes, the rotational force is hardly applied to the turbine blades of the downstream side. Accordingly, in order to improve performance of the steam turbine, it is important to reduce an amount of leaked steam passing through the gap.

Here, a structure shown in FIG. 9 has been proposed (for example, see Patent Literature 1). In this structure, for example, step sections 502 (502A, 502B, 502C) having heights gradually increased from an upstream side toward a downstream side in a rotary axis direction (hereinafter, simply referred to as an axial direction) are formed at a tip section 501 of a turbine blade 500. Seal fins 504 (504A, 504B, 504C) having micro gaps H101, H102 and H103 corresponding to the step sections 502 (502A, 502B, 502C) are formed at a casing 503.

According to the above-mentioned configuration, as a leakage flow passing through the micro gap H101, H102 and H103 of the seal fins 504 (504A, 504B, 504C) collides with end edge sections (edge sections) 505 (505A, 505B, 505C) forming step surfaces 506 (506A, 506B, 506C) of the step sections 502 (502A, 502B, 502C), a flow resistance can be increased. In addition, steam separated by the end edge sections 505 (505A, 505B, 505C) of the step surfaces 506 (506A, 506B, 506C) becomes a separation vortex Y100. The separation vortex Y100 generates a downflow from tips of the seal fins 504 (504A, 504B, 504C) toward the tip section 501 of the turbine blade 500. The downflow exhibits a contraction flow effect of the steam passing through the micro gap H101, H102 and H103. For this reason, a flow rate of the leaked steam passing through the micro gaps H101, H102 and H103 between the casing 503 and the tip section 501 of the turbine blade 500 is reduced.

CITATION LIST

Patent Literature

[Patent Literature 1] Japanese Unexamined Patent Application, First Publication No. 2006-291967

SUMMARY OF INVENTION

Problem to be Solved by the Invention

Here, as shown in FIG. 9, since a density of a fluid passing through the turbine blade 500 is reduced toward the downstream side, a flow velocity of the steam passing through the step sections 502 (502A, 502B, 502C) is increased toward the downstream side. That is, the more the steam separated from the end edge sections 505 (505A, 505B, 505C) of the step surfaces 506 (506A, 506B, 506C) is at the downstream side, the larger a velocity in a radial direction of the steam become. For this reason, when the inclination angles of the step surfaces 506 (506A, 506B, 506C) are set to be equal to each other, as approaching to the downstream, the separation vortex Y100 more curved in the radial direction is formed. Since the separation vortex Y100 having the above-mentioned shape has a small contraction flow effect and a small static pressure reduction effect, a leakage flow rate of the steam passing through the micro gaps 101, H102, H103 of the tip section 501 of the turbine blade 500 cannot be easily reduced.

Here, in consideration of the above-mentioned circumstances, the present invention provides a high performance turbine capable of further reducing the leakage flow rate of the steam passing through the micro gap of the tip section of the blade.

Means for Solving the Problem

A turbine according to the present invention includes a blade and a structure formed at a tip section side of the blade via a gap and configured to relatively rotate with respect to the blade, in the turbine in which a fluid flows through the gap, a step section having at least one step surface and protruding toward the other sections is formed at one of sections opposite to the tip section of the blade and the tip section of the structure, a seal fin extending toward the step section and configured to form a micro gap between the step section and the seal fin is formed at the other sections, and a cutout section formed to be connected to the upper surface of the step section and configured to guide a separation vortex separated from a main stream of the fluid toward the seal fin on the upper surface is formed at the step surface.

According to the above-mentioned configuration, a portion of the main stream of the fluid passing between the blades collides with the step surface and forms a main vortex to return to the upstream side, and a portion flow of the main vortex is separated at an end edge section (an edge) of the step surface and forms a separation vortex rotated in an opposite direction of the main vortex. That is, the separation vortex forms a downflow from a seal fin tip toward the step section. For this reason, since the separation vortex exhibits a contraction flow effect of the fluid passing through the micro gap between the seal fin tip and the step section, a leakage flow rate can be reduced.

Here, the cutout section is formed at the step surface to be connected to the upper surface of the step section. That is, the end edge section of the step surface is cut out by the cutout section, and the separation vortex is guided toward the seal fin rather than the end edge section. For this reason, a diameter of the separation vortex formed in front of the seal fin is reduced in comparison with the case in which the cutout section is not formed. Accordingly, the downflow by the separation vortex near the seal fin tip can be strengthened, and further, a contraction flow effect of the fluid passing through the micro gap can be improved.

In addition, as the diameter of the separation vortex is reduced, a static pressure of the upstream side of the seal fin can be reduced. For this reason, a pressure difference between the upstream side and the downstream side with the seal fin sandwiched therebetween can be reduced. Accordingly, the leakage flow rate can be further reduced.

In the turbine according to the present invention, the step section may have a plurality of the step surfaces such that protrusion heights are gradually increased from an upstream side toward a downstream side thereof, the cutout section may be an inclined section formed at each of the step surfaces and inclined from the upstream side toward the downstream side. An inclination angle of the inclined section with respect to a radial direction of a rotary shaft is set to be larger for the inclined section formed at the step surface located in the downstream side.

According to the above-mentioned configuration, equally the upstream side and the downstream side, a velocity vector of the separation vortex can be directed toward the seal fin tip side (in the axial direction). For this reason, diameters of the separation vortices formed at the step sections can be substantially uniformized. That is, even when flow velocities of the fluid on the step surfaces of the step section are varied, diameters of the separation vortices formed at the step surfaces can be substantially uniformly reduced. Accordingly, a contraction flow effect by the separation vortex of the fluid passing through the micro gap can be more securely improved, and a static pressure of the upstream side of the seal fin can be further securely reduced.

In the turbine according to the present invention, the step section may have a plurality of the step surfaces such that protrusion heights are gradually increased from an upstream side toward a downstream side thereof, the cutout section may have an arc-shaped section formed at each of the step surfaces and smoothly connected to the upper surface from the upstream side toward the downstream side. An angle between a tangential direction of a portion of the arc-shaped section connected to the upper surface and a radial direction of a rotary shaft is set to be larger for the arc-shaped portion formed at the step surface located in the downstream side.

According to the above-mentioned configuration, even when the flow velocities of the fluid on the step surfaces of the step are varied, the diameters of separation vortices formed at the step surfaces can be substantially uniformly reduced. For this reason, the contraction flow effect by the separation vortex of the fluid passing through the micro gap can be more securely improved, and the static pressure of the upstream side of the seal fin can be more securely reduced.

Effects of the Invention

According to the present invention, in comparison with a case in which the cutout section is not formed, the diameter of the separation vortex formed in front of the seal fin can be reduced. For this reason, the downflow by the separation vortex near the seal fin tip can be strengthened, and a contraction flow effect of the fluid passing through the micro gap can be improved.

In addition, as the diameter of the separation vortex is reduced, the static pressure of the upstream side of the seal fin can be reduced. For this reason, a pressure difference between the upstream side and the downstream side with the seal fin sandwiched therebetween can be reduced. Accordingly, the leakage flow rate can be further reduced.

DESCRIPTION OF EMBODIMENTS (Steam Turbine)

Next, an embodiment of the present invention will be described with reference to FIGS. 1 to 4.

Figure 1:
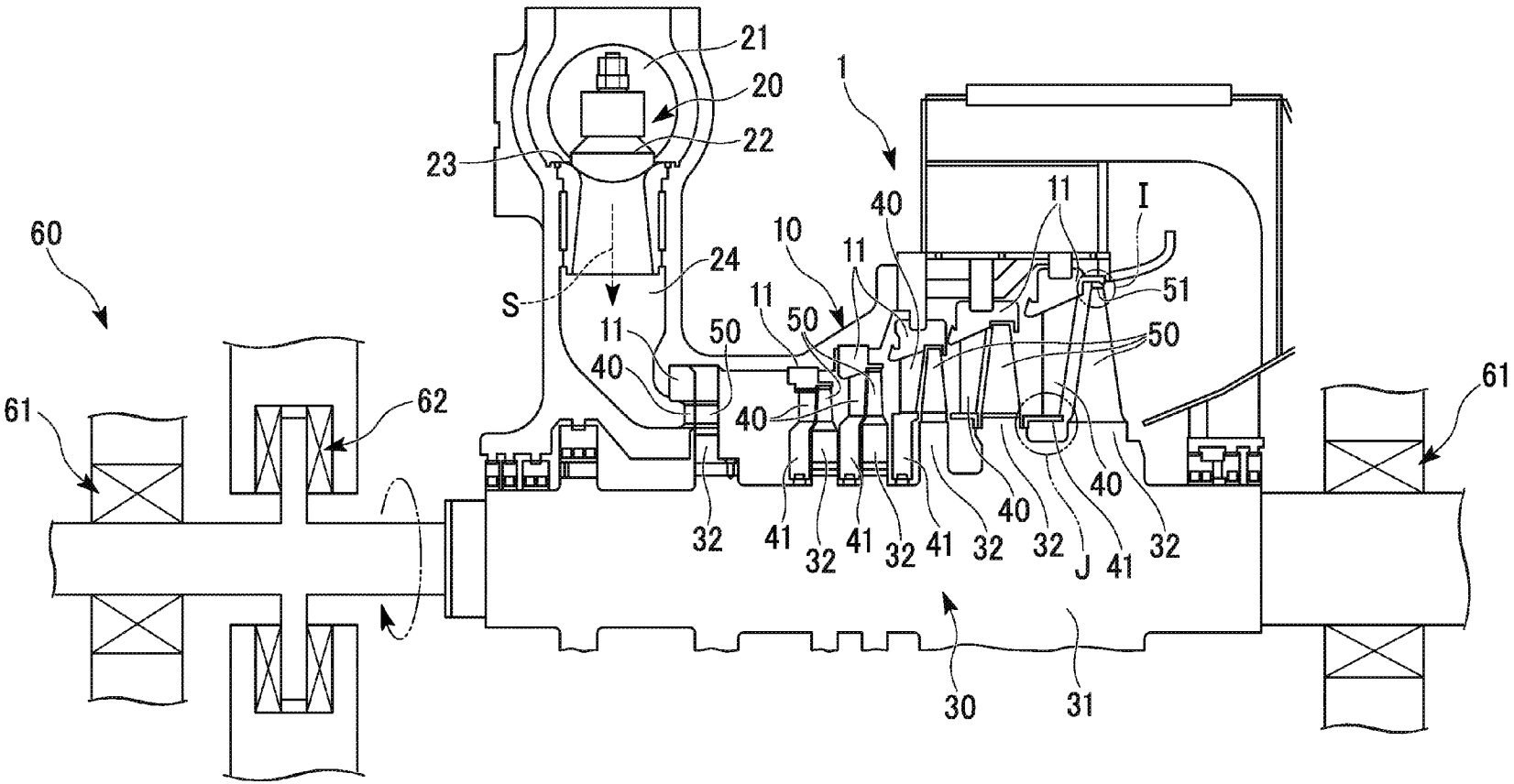
FIG. 1 is a schematic cross-sectional view of a configuration showing a steam turbine according to an embodiment of the present invention.

FIG. 1 is a schematic cross-sectional view of a configuration showing a steam turbine according to the embodiment of the present invention.

A steam turbine 1 is mainly constituted by a casing 10, a regulating valve 20 configured to regulate an amount and a pressure of steam S entering the casing 10, a shaft body 30 rotatably installed in the casing 10 and configured to transmit power to a machine such as a generator or the like (not shown), turbine vanes 40 held by the casing 10, turbine blades 50 installed at the shaft body 30, and a bearing unit 60 configured to axially rotatably support the shaft body 30.

The bearing unit 60 includes a journal bearing device 61 and a thrust bearing device 62, which rotatably support the shaft body 30.

The casing 10 is a flow path of the steam S. An internal space of the casing 10 is hermetically sealed. A ring-shaped partition plate outer wheel 11 into which the shaft body 30 is inserted is strongly fixed to an inner wall surface of the casing 10.

The plurality of regulating valves 20 are attached to the inside of the casing 10. Each of the regulating valves 20 includes a regulating valve chamfer 21 into which the steam S enters from a boiler (not shown), a valve body 22, and a valve seat 23. As a steam flow path is opened when the valve body 22 is separated from the valve seat 23, the steam S enters an internal space of the casing 10 via a steam chamfer 24.

The shaft body 30 includes a shaft main body 31, and a plurality of disks 32 extending from an outer circumference of the shaft main body 31 in a radial direction of a rotary axis (hereinafter, simply referred to as a radial direction). The shaft body 30 transmits rotational energy to a machine such as a generator or the like (not shown).

The plurality of turbine vanes 40 is radially disposed to surround the shaft body 30 to form an annular turbine vane group. Each of the turbine vanes 40 is held by the partition plate outer wheel 11. Inner sides in the radial direction of the turbine vanes 40 are connected to a ring-shaped hub shroud 41. The shaft body 30 is inserted into the hub shroud 41. A tip section of the turbine vane 40 is disposed to be spaced by a gap in the radial direction from the shaft body 30.

Six annular turbine vane groups, each constituted by the plurality of turbine vanes 40, are formed in the axial direction at an interval. The annular turbine vane group converts pressure energy of the steam S into velocity energy, and guides the steam S toward the turbine blade 50 adjacent to the downstream side.

The turbine blade 50 is strongly attached to an outer circumferential section of the disk 32 included in the shaft body 30. The plurality of turbine blades 50 is radially disposed at the downstream side of each annular turbine vane group to form an annular turbine blade group.

One stage is formed of one set of the annular turbine vane group and the annular turbine blade group. The steam turbine 1 has six sets of annular turbine vane groups and annular turbine blade groups. A tip shroud 51 extending in a circumferential direction is installed at the tip sections of the turbine blades 50.

Here, in the embodiment, the shaft body 30 and the partition plate outer wheel 11 constitute "a structure" of the present invention. In addition, the turbine vane 40, the hub shroud 41, the tip shroud 51 and the turbine blade 50 constitute "a blade" of the present invention. Then, when the turbine vane 40 and the hub shroud 41 are "the blade," the shaft body 30 is "the structure." Meanwhile, when the turbine blade 50 and the tip shroud 51 are "the blade," the partition plate outer wheel 11 is "the structure." In addition, in the following description, the partition plate outer wheel 11 will be described as "the structure," and the turbine blade 50 will be described as "the blade."

Figure 2:
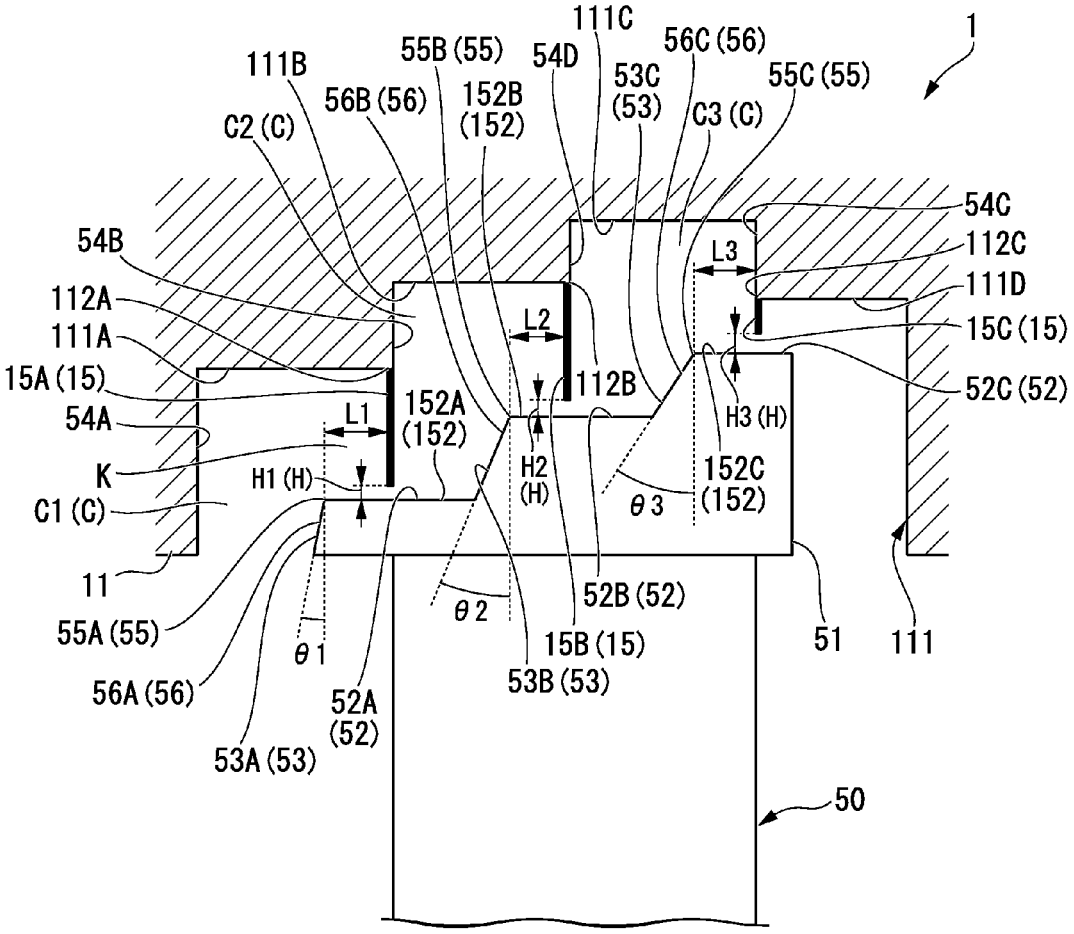
FIG. 2 is an enlarged cross-sectional view showing a major part I of FIG. 1.

FIG. 2 is an enlarged cross-sectional view showing a major part I of FIG. 1.

As shown in FIG. 2, the tip shroud 51 installed at the tip section of the turbine blade 50 is disposed to oppose the partition plate outer wheel 11 fixed to the casing 10 via a gap K. The tip shroud 51 includes step sections 52 (52A to 52C) protruding toward the partition plate outer wheel 11. The step sections 52 (52A to 52C) have step surfaces 53 (53A to 53C), respectively.

The tip shroud 51 of the embodiment includes the three step sections 52 (52A to 52C). Protrusion heights of upper surfaces 152 (152A to 152C) of the three step sections 52A to 52C from the turbine blade 50 are gradually increased from the upstream side in the axial direction (a left side of FIG. 2) of the shaft body 30 toward the downstream side (a right side of FIG. 2). The step surfaces 53 (53A to 53C) of the step sections 52A to 52C are directed to the upstream side in the axial direction.

Here, the step surfaces 53 (53A to 53C) form inclined sections 56 (56A to 56C) to be inclined toward the downstream side, respectively. That is, the step surfaces 53 (53A to 53C) are obliquely cut out and forms the inclined sections 56 (56A to 56C). Then, upper edge sections 55 (55A to 55C) of the inclined sections 56 (56A to 56C) are connected to the upper surfaces 152 (152A to 152C) of the step sections 52 (52A to 52C).

In addition, inclination angles θ1 to θ3 of the inclined sections 56 (56A to 56C) with respect to the radial direction are set to be increased toward the downstream side. That is, in the three step sections 52 (52A to 52C), the inclination angle with respect to the radial direction of the inclined section 56A formed at the step surface 53A of the step section 52A of a first stage disposed at the most upstream side is defined as θ1. The inclination angle with respect to the radial direction of the inclined section 56B formed at the step surface 53B of the step section 52B of a second stage, which is disposed at a downstream side of the step section 52A of the first stage, is defined as θ2. The inclination angle with respect to the radial direction of the inclined sections 56C formed at the step surface 53C of the step section 52C of a third stage, which is disposed at a downstream side of the step section 52B of the second stage, is defined as θ3.

The angles θ1, θ2 and θ3 are set to satisfy θ3>θ2>θ1.

Meanwhile, annular grooves 111 are formed in the partition plate outer wheel 11 at areas opposite to the step sections 52 of the tip shroud 51. The annular grooves 111 have three annular concave sections 111A to 111C having diameters gradually increased from the upstream side toward the downstream side to correspond to the three step sections 52 (52A to 52C). In addition, the annular grooves 111 have a concave section 111D of a fourth stage formed at the most downstream side and having a diameter smaller than that of the concave section 111C of the third stage.

Here, three seal fins 15 (15A to 15C) extending inward in the radial direction toward the tip shroud 51 are installed at an end edge section (edge section) 112A disposed at a boundary between the concave section 111A of the first stage and the concave section 111B of the second stage, an end edge section 112B disposed at a boundary between the concave section 111B of the second stage and the concave section 111C of the third stage, and an end edge section 112C disposed at a boundary between the concave section 111C of the third stage and the concave section 111D of the fourth stage. The seal fins 15 (15A to 15C) face the step sections 52 (52A to 52C), respectively.

The seal fins 15 (15A to 15C) form micro gaps H (H1 to H3) in the radial direction between the seal fins 15 (15A to 15C) and the step sections 52 (52A to 52C) corresponding thereto, respectively. Each dimension of the micro gaps H (H1 to H3) is set to a minimum value within a safe range as long as the casing 10 and the turbine blade 50 do not come in contact with each other in consideration of a heat elongation quantity of the casing 10 or the turbine blade 50, a centrifugal elongation quantity of the turbine blade 50, or the like.

In addition, in the embodiment, all of H1 to H3 are the same dimension. However, H1 to H3 can be appropriately varied according to necessity.

Based on the above-mentioned configuration, between the tip shroud 51 and the partition plate outer wheel 11, cavities C (C1 to C3) are formed between the step sections 52 (52A to 52C) and the three concave sections 111A to 111C of the annular groove 111 corresponding thereto, respectively.

More specifically, the first cavity C1 formed at the most upstream side and corresponding to the step section 52A of the first stage is formed between the seal fin 15A corresponding to the step section 52A of the first stage and an inner wall surface 54A of the first stage of an upstream side of the concave section 111A, and besides between the tip shroud 51 and the partition plate outer wheel 11.

In addition, the second cavity C2 corresponding to the step section 52B of the second stage is formed between the seal fin 15B corresponding to the step section 52B of the second stage, and an inner wall surface 54B of the upstream side of the concave section 111B of the second stage and the seal fin 15A formed at the end edge section 112A, and besides between the tip shroud 51 and the partition plate outer wheel 11.

Further, the third cavity C3 corresponding to the step section 52C of the third stage is formed between the seal fin 15C corresponding to the step section 52C of the third stage and an inner wall surface 54C of the downstream side of the concave section 111C of the third stage, and an inner wall surface 54D of the upstream side of the concave section 111C of the third stage and the seal fin 15B formed at the end edge section 112B, and besides between the tip shroud 51 and the partition plate outer wheel 11.

(Operation of Steam Turbine)

Next, an operation of the steam turbine 1 will be described based on FIGS. 1 to 3.

Figure 3:
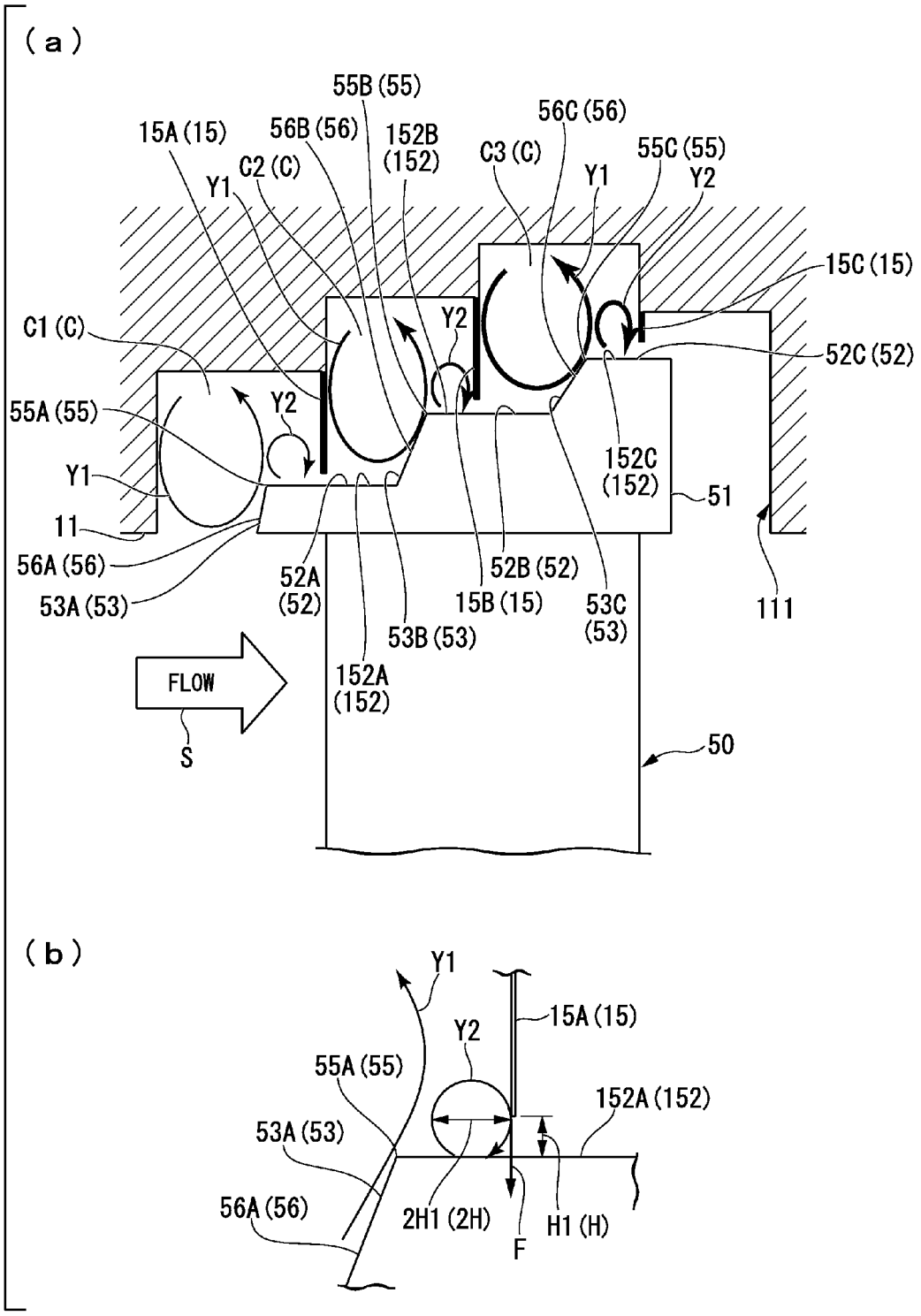
FIG. 3 is a view for describing an action of the steam turbine according to the embodiment of the present invention, FIG. 3(*a*) shows an enlarged view of the major part I of FIG. 1, and FIG. 3(*b*) shows an enlarged view of a major part of FIG. 3(*a*).

FIG. 3 is a view for describing an operation of the steam turbine, FIG. 3(*a*) shows an enlarged view of a major part I of FIG. 1, and FIG. 3(*b*) shows an enlarged view of a major part of FIG. 3(*a*).

As shown in FIG. 1 to FIG. 3(*a*), first, when the regulating valve 20 (see FIG. 1) becomes opened, the steam S enters the internal space of the casing 10 from a boiler (not shown).

The steam S entering the internal space of the casing 10 sequentially passes through the annular turbine vane group and the annular turbine blade group of each stage. Here, pressure energy is converted into velocity energy by the turbine vane 40. Most of the steam S passing through the turbine vanes 40 flows between the turbine blades 50 constituting the same stage. The turbine blades 50 convert the velocity energy of the steam S into rotational energy, and apply rotation to the shaft body 30. Meanwhile, a portion of the steam S (for example, several %) exits from the turbine vane 40, and then enters the annular groove 111, becoming so-called leaked steam.

Here, as shown in FIG. 3(*a*), first, the steam S entering the annular groove 111 enters the first cavity C1 and collides with the step surface 53A of the step section 52A of the first stage. The steam S returns to the upstream side, and then, a main vortex Y1, for example rotating counterclockwise in the drawing of FIG. 3, is generated.

Here, in particular, in the upper edge section 55A of the step section 52A of the first stage, as a partial flow is separated from the main vortex Y1, a separation vortex Y2 is generated to rotate in an opposite direction of the main vortex Y1, in this example, clockwise in the drawing of FIG. 3.

Here, the step surface 53A of the step section 52A of the first stage forms the inclined section 56A to be inclined toward the downstream side. For this reason, a velocity vector of the main vortex Y1 in the upper edge section 55A is inclined toward the seal fin 15A in comparison with the case in which the step surface 53A does not form the inclined section 56A. Accordingly, a diameter of the separation vortex Y2 formed on the upper surface 152A of the step section 52A of the first stage is reduced in comparison with the case in which the step surface 53A does not form the inclined section 56A.

Such a separation vortex Y2 exhibits an effect of reducing the leakage flow escaping through the micro gap H1 between the seal fin 15A and the step section 52A, i.e., a contraction flow effect.

That is, as shown in FIG. 3(*a*), when the separation vortex Y2 is formed, the separation vortex Y2 forms a downflow to direct the velocity vector inward in the radial direction at the upstream side in the axial direction of the tip of the seal fin 15A. Since the downflow has an inertial force inward in the radial direction in front of the micro gap H1, the effect (contraction flow effect) of reducing the flow escaping through the micro gap H1 inward in the radial direction is exhibited. Accordingly, a leakage flow rate of the steam S is reduced.

Here, as shown in FIG. 3(*b*), assuming that the separation vortex Y2 forms a perfect circle, when the diameter of the separation vortex Y2 becomes two times the micro gap H1 and the outer circumference comes in contact with the seal fin 15A, a position, at which a velocity component F directed inward in the radial direction of the downflow in which the separation vortex Y2 is formed is maximized, coincides with a tip (an inner edge) of the seal fin 15A. In this case, since the downflow passes in front of the micro gap H1 at a higher velocity, a contraction flow effect for the leakage flow is maximized.

In the embodiment, the step surface 53A of the step section 52A of the first stage forms the inclined section 56A. Accordingly, since the diameter of the separation vortex Y2 is reduced in comparison with the case in which the inclined section 56A is not formed at the step surface 53A, the diameter of the separation vortex Y2 is easily set to two times the micro gap H1.

In addition, provided that a distance between the seal fin 15A and the upper edge section 55A of the inclined section 56A disposed at an upstream side thereof is defined as L1, the distance L1 and the inclination angle θ1 of the inclined sections 56 may be set such that the diameter of the separation vortex Y2 is two times the micro gap H1.

Next, the steam S passing through the micro gap H1 enters the second cavity C2, and collides with the step surface 53B of the step section 52B of the second stage. As the steam S returns to the upstream side, the main vortex Y1, for example rotated counterclockwise in the drawing of FIG. 3, occurs. Then, in the upper edge section 55B of the step section 52B of the second stage, as a partial flow is separated from the main vortex Y1, the separation vortex Y2 occurs to be rotated in an opposite direction of the main vortex Y1, in the example, clockwise in the drawing of FIG. 3.

Further, the steam S passing through the micro gap H2 enters the third cavity C3, and collides with the step surface 53C of the step section 52C of the third stage. As the steam S returns to the upstream side, the main vortex Y1, for example rotated counterclockwise in the drawing of FIG. 3, occurs. Then, in the upper edge section 55C of the step section 52C of the third stage, as a partial flow is separated from the main vortex Y1, the separation vortex Y2 occurs to be rotated in an opposite direction of the main vortex Y1, in the example, clockwise in the drawing of FIG. 3.

Here, since a density of the steam S is reduced toward the downstream side, the more the cavities C is at the downstream side, the larger a flow velocity in a meridian plane of the stream S. For this reason, a flow of the steam S colliding with the step surface 53B in the second cavity C2 toward the outside in the radial direction is strengthened more than a flow of the steam S colliding with the step surface 53A in the first cavity C1 toward the outside in the radial direction. Accordingly, the diameter of the separation vortex Y2 formed on the upper surface 152B of the step section 52B of the second stage is easily increased more than the diameter of the separation vortex Y2 formed on the upper surface 152A of the step section 52A of the first stage.

Similarly, in the third cavity C3, the diameter of the separation vortex Y2 formed on the upper surface 152C of the step section 52C of the third stage is easily increased more than the diameter of the separation vortex Y2 formed on the step section 52B of the second stage.

However, in the embodiment, the inclination angles θ1 to θ3 of the inclined sections 56A to 56C formed by the step surfaces 53A to 53C are set to satisfy θ3>θ2>θ1, i.e., to be increased toward the downstream side (see FIG. 2). For this reason, velocity vectors of the separation vortices Y2 formed in the cavities C (C1 to C3) can be directed toward the seal fins 15 (15A to 15C) (in the axial direction). Accordingly, the diameters of the separation vortices Y2 have substantially the same values.

In addition, a distance L2 between the seal fin 15B corresponding to the step section 52B of the second stage and the upper edge section 55B of the inclined section 56B disposed at an upstream side thereof, and the inclination angle θ2 of the inclined section 56B may be set such that the diameter of the separation vortex Y2 is two times the micro gap H2, like the distance L1 and the inclination angle θ1. Further, a distance L3 between the seal fin 15C corresponding to the step section 52C of the third stage and the upper edge section 55C of the inclined section 56C disposed at an upstream side thereof, and the inclination angle θ3 of the inclined section 56C may be set such that the diameter of the separation vortex Y2 is two times the micro gap H3, like the distance L1 and the inclination angle θ1.

(Effect)

Accordingly, according to the above-described embodiment, as the three step sections 52 (52A to 52C) are formed at the tip shroud 51 and the three seal fins 15 (15A to 15C) are formed at areas corresponding to the step sections 52 (52A to 52C) of the annular groove 111 formed at the partition plate outer wheel 11, the separation vortices Y2 can be formed at upstream sides of the seal fins 15 (15A to 15C). Since the separation vortex Y2 forms a downflow, in which a velocity vector is directed inward in the radial direction, at the upstream side in the axial direction of the seal fin 15A, an effect of reducing a leakage flow escaping through the micro gaps H (H1 to H3), i.e., a contraction flow effect, can be exhibited.

Additionally, the step surfaces 53 (53A to 53C) of the step sections 52 (52A to 52C) form the inclined sections 56 (56A to 56C), and the inclination angles θ1 to θ3 of the inclined sections 56 (56A to 56C) are set to be increased toward the downstream side. That is, the inclination angles θ1 to θ3 are set to satisfy θ3>θ2>θ1.

For this reason, since the diameters of the separation vortices Y2 formed in the cavities C (C1 to C3) have substantially the same values, the downflow at the upstream side in the axial direction of the seal fins 15 (15A to 15C) can be strengthened. Accordingly, an effect of reducing a leakage flow escaping through the micro gaps H (H1 to H3), i.e., a contraction flow effect, can be securely exhibited.

In addition, in the above-described embodiment, the case in which the step surfaces 53 (53A to 53C) are obliquely cut out to form the inclined sections 56 (56A to 56C) and the upper edge sections 55 (55A to 55C) of the inclined sections 56 (56A to 56C) are connected to the upper surfaces 152 (152A to 152C) of the step sections 52 (52A to 52C) has been described. However, the present invention is not limited thereto but the step surfaces 53 (53A to 53C) may be cut out to be connected to at least the upper surfaces 152 (152A to 152C) of the step sections 52 (52A to 52C).

(First Modified Example)

More specifically, the present invention will be described based on FIGS. 4 to 8.

Figure 4:
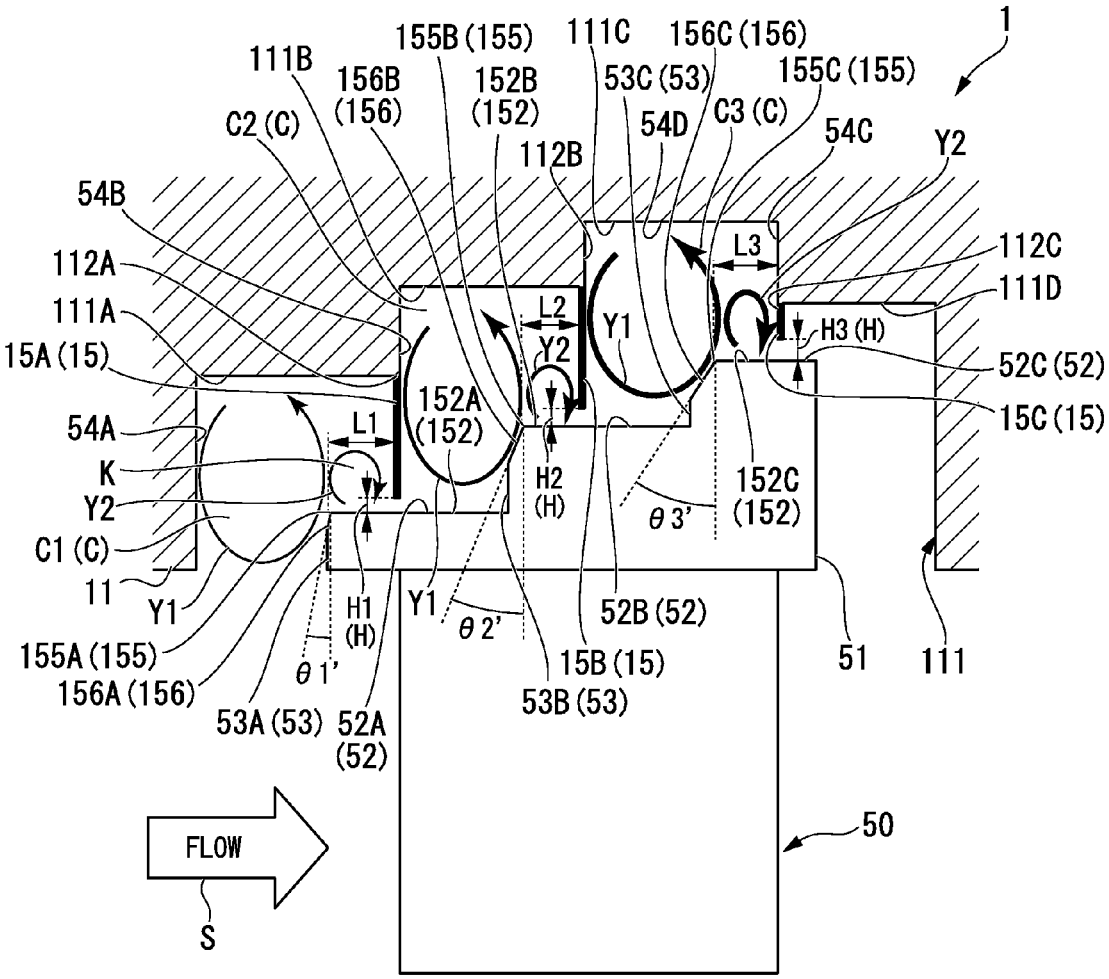
FIG. 4 is a schematic cross-sectional view of a configuration of a step section according to a first modified example of the present invention.

FIG. 4 is a schematic cross-sectional view of a configuration of a first modified example of the step section. In addition, the same elements as in the above-described embodiment are designated and described by the same reference numerals (the same as even in the following modified examples).

As shown in FIG. 4, flat chamfer sections 156 (156A to 156B) are formed at end edge sections (edge sections) of the step surfaces 53 (53A to 53C) of the three step sections 52 (52A to 52C) formed in the tip shroud 51, respectively. That is, the upper surface 152 (152A to 152C) sides of the step surfaces 53 (53A to 53C) are obliquely cut out. Then, upper edge sections 155 (155A to 155C) of the chamfer sections 156 (156A to 156C) are connected to the upper surfaces 152 (152A to 152C), respectively.

In addition, inclination angles θ1' to θ3' of the chamfer sections 156 (156A to 156C) with respect to the radial direction are set to be increased toward the downstream side (a right side of FIG. 4). That is, the inclination angle θ1' of the chamfer section 156A formed at the step surface 53A of the step section 52A of the first stage, the inclination angle θ2' of the chamfer section 156B formed at the step surface 53B of the step section 52B of the second stage, and the inclination angle θ3' of the chamfer section 156C formed at the step surface 53C of the step section 52C of the third stage are set to satisfy θ3'>θ2'>θ1'.

Accordingly, the above-described first modified example exhibits the same effect as the above-mentioned embodiment. In addition, cutout amounts of the step sections 52 (52A to 52C) of the chamfer sections 156 (156A to 156C) are reduced in comparison with the case in which the inclined sections 56 (56A to 56C) of the above-mentioned embodiment are formed. Accordingly, processing cost can be reduced.

(Second Modified Example)

Figure 5:
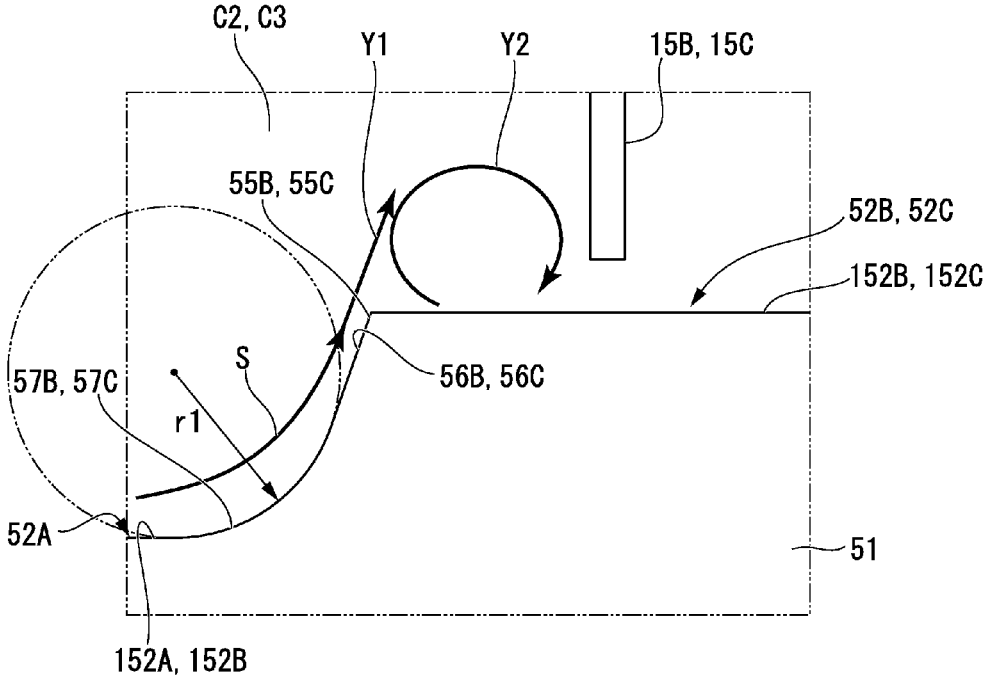
FIG. 5 is a schematic cross-sectional view of a configuration of a step section according to a second modified example of the present invention.

FIG. 5 is a schematic cross-sectional view of a configuration of a second modified example of the step section. In addition, in the following drawing, the second modified example is the same as the above-described embodiment in that the three step sections 52 (52A to 52C) are formed at the tip shroud 51. Then, since the step sections 52 (52A to 52C) have the same configuration, only a portion of the step sections 52 is shown, and the other step sections 52 are omitted.

As shown in FIG. 5, the second modified example is distinguished from the above-described embodiment in that, while the inclined sections 56 (56A to 56C) are simply formed at the step surfaces 53 (53A to 53C) of the step sections 52 (52A to 52C) of the above-described embodiment, respectively, in the second modified example, arc-shaped sections 57B and 57C having a radius r1 are formed at a connecting portion of the upper surface 152A of the step section 52A of the first stage and the inclined section 56B formed at the step section 52B of the second stage and a connecting portion of the upper surface 152B of the step section 52B of the second stage and inclined sections 56C formed at the step section 52C of the third stage, to be concaved toward the downstream side (a right side of FIG. 5).

The upper surface 152A of the step section 52A of the first stage is smoothly connected to the inclined section 56B formed at the step section 52B of the second stage by the arc-shaped section 57B. In addition, the upper surface 152B of the step section 52B of the second stage is smoothly connected to the inclined section 56C formed at the step section 52C of the third stage by the arc-shaped section 57C.

Accordingly, according to the second modified example, the leaked steam can be smoothly guided to the inclined sections 57 (57A to 57C), and energy loss of the main vortex Y1 exiting from the upper edge sections 55 (55A to 55C) of the inclined sections 57 (57A to 57C) can be reduced. As a result, since the downflow of the separation vortex Y2 can be increased, a larger contraction flow effect can be exhibited in the separation vortex Y2.

(Third Modified Example)

Figure 6:
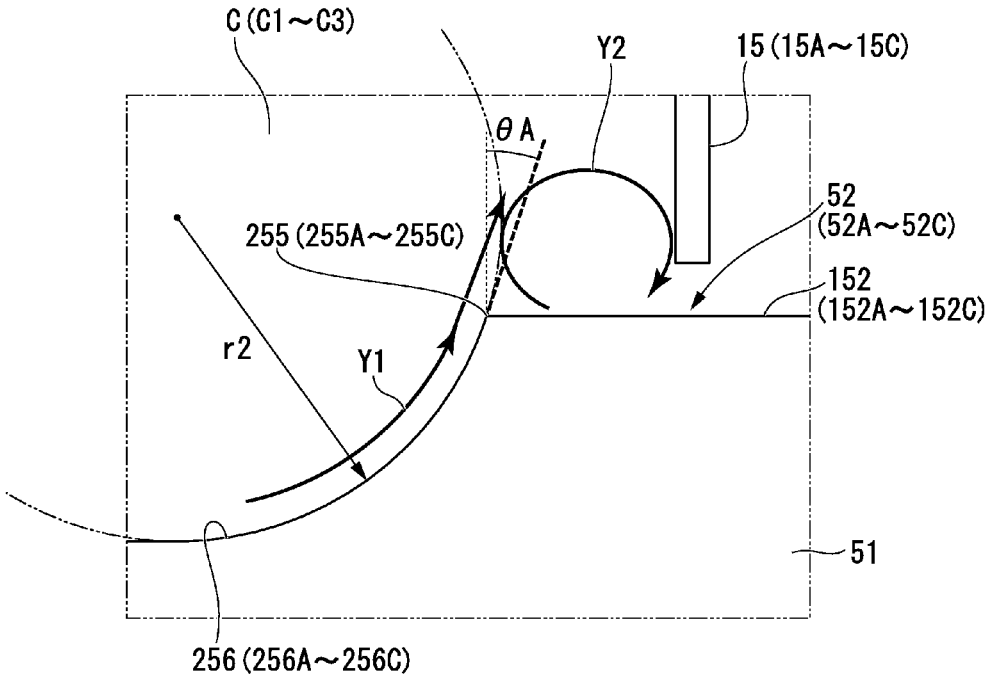
FIG. 6 is a schematic cross-sectional view of a configuration of a step section according to a third modified example of the present invention.

FIG. 6 is a schematic cross-sectional view of a configuration of a third modified example of the step section.

As shown in FIG. 6, the third modified example is distinguished from the above-described embodiment in that, while only the inclined sections 56 (56A to 56C) are formed at the step surfaces 53 (53A to 53C) of the step sections 52 (52A to 52C) of the above-described embodiment, respectively, in the third modified example, instead of the inclined sections 56 (56A to 56C), only arc-shaped sections 256 (256A to 256C) having a radius r2 are formed.

The arc-shaped sections 256 (256A to 256C) are formed to be concaved toward the downstream side (a right side of FIG. 6). Then, upper edge sections 255 (255A to 255C) of the arc-shaped sections 256 (256A to 256C) are connected to the upper surfaces 152 (152A to 152C) of the step sections 52 (52A to 52C). Here, an angle OA between a tangential direction and a radial direction of arc-shaped sections 256 (256A to 256C) of the upper edge sections 255 (255A to 255C) is set to be increased toward the downstream side.

Accordingly, the third modified example exhibits the same effect as the above-mentioned embodiment. In addition, since the leaked steam can be more smoothly guided to the upper edge sections 255 (255A to 255C) of the arc-shaped sections 256 (256A to 256C) than in the above-mentioned embodiment, energy loss of the main vortex Y1 can be reduced. As a result, since the downflow of the separation vortex Y2 can be further increased, a large contraction flow effect can be exhibited by the separation vortex Y2.

(Fourth Modified Example)

Figure 7:
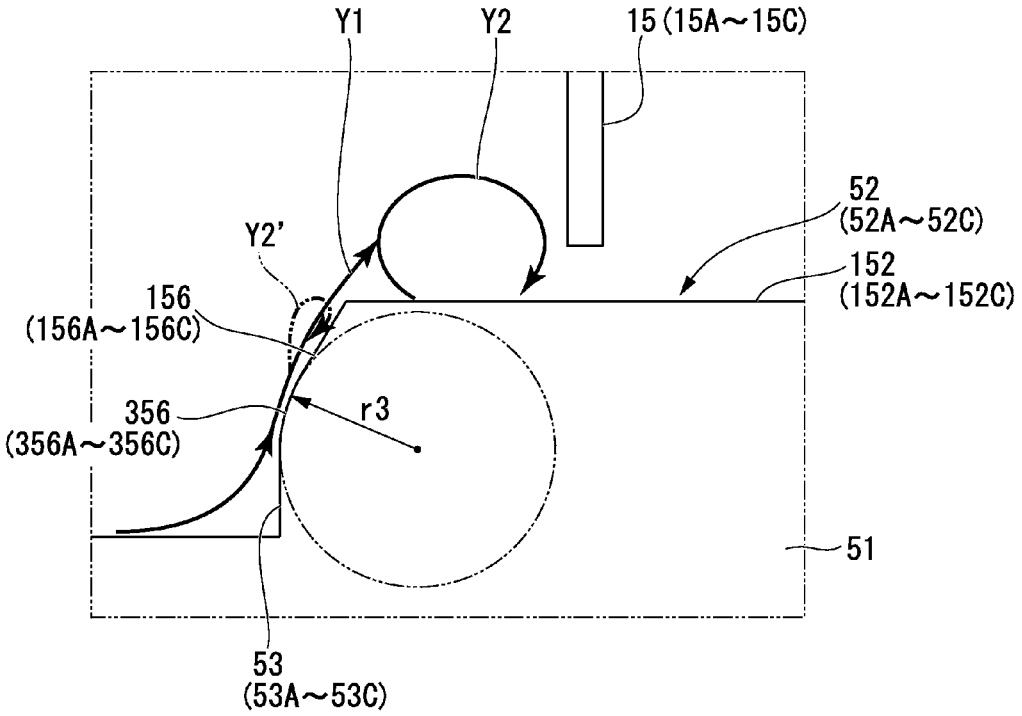
FIG. 7 is a schematic cross-sectional view of a configuration of a step section according to a fourth modified example of the present invention.

FIG. 7 is a schematic cross-sectional view of a fourth modified example of the step section.

As shown in the same drawing, the fourth modified example is distinguished from the above-mentioned first modified example in that, while the flat chamfer sections 156 (156A to 156C) are formed at the end edge sections (edge sections) of the step surfaces 53 (53A to 53C) of the step sections 52 (52A to 52C) of the first modified example, respectively, circular chamfer sections 356 (356A to 356C) having a radius r3 are formed at lower edge sides of the flat chamfer sections 156 (156A to 156C) of the fourth modified example.

The step surfaces 53 (53A to 53C) and the flat chamfer sections 156 (156A to 156B) are smoothly connected by the circular chamfer sections 356 (356A to 356C). For this reason, the steam S colliding with the step surfaces 53 (53A to 53C) is smoothly guided to the flat chamfer sections 156 (156A to 156C). As a result, small separation vortices Y2' (see a two-dot chain line of FIG. 7) can be securely prevented from being separated from the main vortex Y1 and formed at lower edge portions of the flat chamfer sections 156 (156A to 156C). Accordingly, since energy loss of the main vortex Y1 can be reduced, a contraction flow effect by the separation vortex Y2 can be increased.

(Fifth Modified Example)

Figure 8:
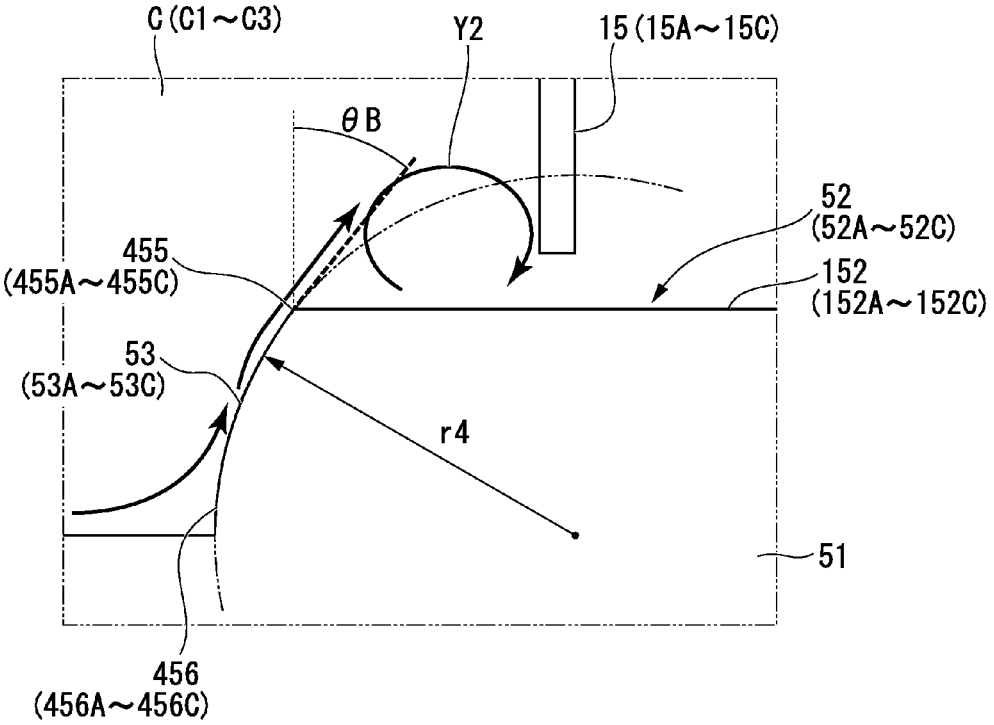
FIG. 8 is a schematic cross-sectional view of a configuration of a step section according to a fifth modified example of the present invention.
Figure 9:
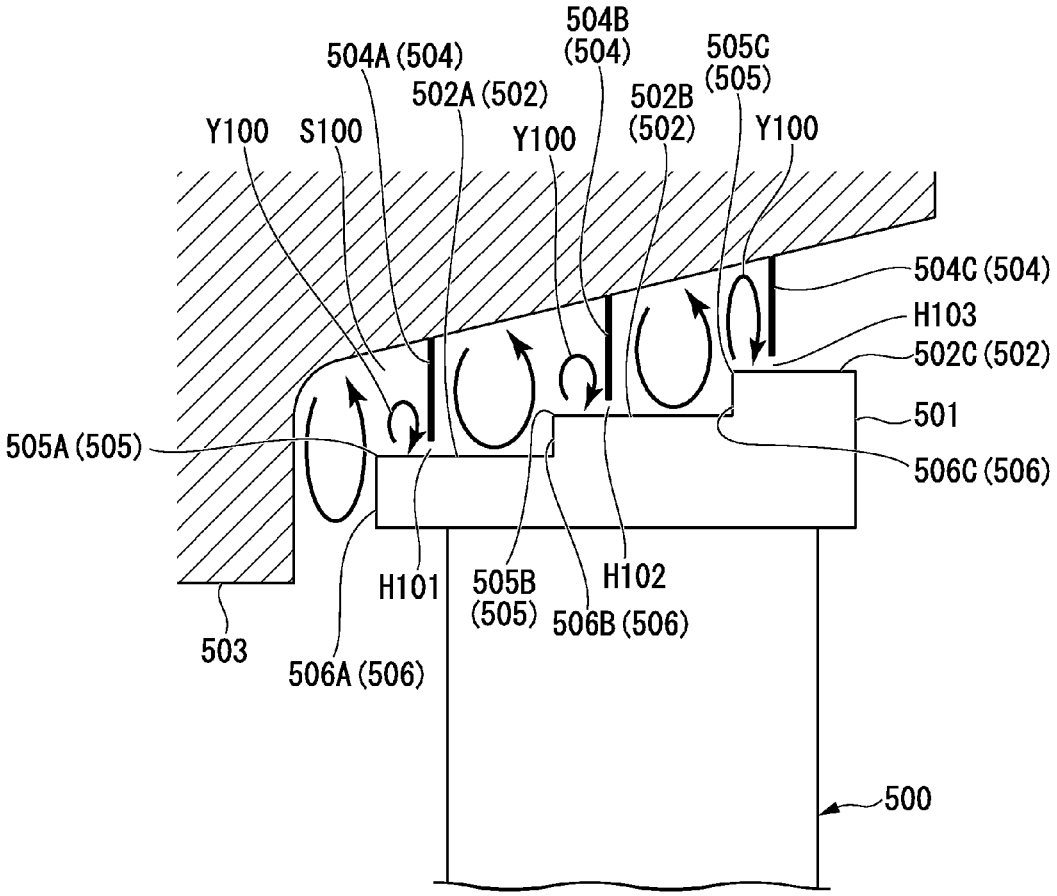
FIG. 9 is a schematic view of a configuration of a major part of a related steam turbine.

FIG. 8 is a schematic cross-sectional view of a fifth modified example of the step section.

As shown in FIG. 8, the fifth modified example is distinguished from the above-mentioned third modified example in that arc-shaped sections 456 (456A to 456C) having a radius r4 are formed at the step surfaces 53 (53A to 53C) of the step sections 52 (52A to 52C) of the fifth modified example, respectively.

That is, while the arc-shaped sections 256 (256A to 256C) of the third modified example are formed to be concaved toward the downstream side (a right side of FIG. 6), the arc-shaped sections 456 (456A to 456C) of the fifth modified example are formed to swell toward the upstream side (a left side of FIG. 8). Then, upper edge sections 455 (455A to 455C) of the arc-shaped sections 456 (456A to 456C) are connected to the upper surfaces 152 (152A to 152C) of the step sections 52 (52A to 52C).

Here, an angle θB between a tangential direction and a radial direction of the arc-shaped sections 456 (456A to 456C) of the upper edge sections 455 (455A to 455C) is set to be increased toward the downstream side.

Accordingly, the above-described fifth modified example exhibits the same effect as the above-mentioned third modified example.

In addition, the present invention is not limited to the above-described embodiment but includes the above-described embodiment applied various modifications without departing from the spirit of the present invention.

For example, in the above-described embodiment or the modified example, the partition plate outer wheel 11 installed at the casing 10 is provided as a structure. However, it is not limited thereto but the casing 10 itself may be provided as a structure of the present invention without installing the partition plate outer wheel 11. That is, the structure may be any member as long as the structure surrounds the turbine blades 50 and defines a flow path such that the fluid passes between the turbine blades.

In addition, in the above-described embodiment or the modified example, the case in which the annular grooves 111 at the portion corresponding to the tip shroud 51 of the partition plate outer wheel 11 is formed and the annular grooves 111 have the three annular concave sections 111A to 111C having diameters gradually increased by step differences and the concave section 111D of the fourth stage having a smaller diameter than the concave section 111C of the third stage to correspond to the three step sections 52 (52A to 52C), are provided has been described. However, it is not limited thereto but all of the annular grooves 111 may have substantially the same diameter.

Further, in the above-described embodiment or the modified example, the case in which the plurality of step sections 52 are formed at the tip shroud 51 and thus the plurality of cavities C are also formed has been described. However, it is not limited thereto but the number of step sections 52 or cavities C corresponding thereto may be arbitrary, i.e., one, three, four or more step sections or cavities may be provided.

In addition, the plurality of seal fins 15 may be formed to face to one step section 52.

Further, in the above-described embodiment or the modified example, while the present invention is applied to the turbine blade 50 or the turbine vane 40 of the final stage, the present invention may be applied to the turbine blade 50 or the turbine vane 40 of another stage.

Furthermore, in the above-described embodiment or the modified example, "the blade" according to the present invention is provided as the turbine blade 50, and the step sections 52 (52A to 52C) are formed at the tip shroud 51, which becomes the tip section. In addition, "the structure" according to the present invention is provided as the partition plate outer wheel 11, and the seal fins 15 (15A to 15C) are formed at the partition plate outer wheel 11. However, it is not limited thereto but "the blade" according to the present invention may be provided as the turbine vane 40 and the step sections 52 may be formed at the tip section. In addition, "the structure" according to the present invention may be provided as the shaft body (rotor) 30 and the seal fins 15 may be formed at the shaft body 30. Even in this case, the above-described embodiment or the modified example can be applied to the step sections 52.

In addition, in the above-described embodiment, while the present invention is applied to the condensation type steam turbine 1, the present invention can be applied to another type of steam turbine, for example, a two-stage extraction turbine, an extraction turbine, a mixed gas turbine, or the like.

Further, in the above-described embodiment, while the present invention is applied to the steam turbine 1, the present invention can be applied to a gas turbine, and further, the present invention can be applied to all turbines having rotating blades.

INDUSTRIAL APPLICABILITY

The present invention relates to a turbine used in, for example, a power plant, a chemical plant, a gas plant, a steelworks, a ship, or the like. According to the present invention, a leakage amount of a working fluid can be reduced.

REFERENCE SIGNS LIST

1 steam turbine (turbine)
10 casing
11 partition plate outer wheel (structure)
15 (15A to 15C) seal fin
30 shaft body (structure)
40 turbine vane (blade)
41 hub shroud
50 turbine blade (blade)
51 tip shroud
52 (52A to 52C) step section
53 (53A to 53C) step surface
55 (55A to 55C), 155 (155A to 155C), 455 (455A to 455C) upper edge section
56 (56A to 56C) inclined section
57B, 57C, 256 (256A to 256C), 456 (456A to 456C) arc-shaped section
156 (156A to 156C) flat chamfer section (cutout section)
356 (356A to 356C) circular chamfer section
C (C1 to C3) cavity
H (H1 to H3) micro gap
K gap
S steam
Y1 main vortex
Y2 separation vortex
θ1 to θ3, θ1' to θ3' inclination angle
θA, θB angle

What is claimed is:

1. A turbine comprising:

a blade;

a structure installed at a tip section side of the blade via a gap and configured to relatively rotate with respect to the blade;

a step section formed at one of sections, the tip section of the blade and a section of the structure opposite to the tip section, protruding toward the other sections such that protrusion heights are gradually increased from an upstream side toward a downstream side of the step section, and having a first step surface and a second step surface which is provided on a downstream side of the first step surface;

a seal fin formed at the other of sections, the tip section of the blade and a section of the structure opposite to the tip section, extending toward the step section, and configured to form a micro gap between the step section and the seal fin; and a cutout section formed at each of the first step surface and the second step surface to be connected to an upper surface of the step section, wherein a fluid flows through the gap, the cutout sections guide a separation vortex separated from a main stream of the fluid toward the seal fin on the upper surface of the step section, the cutout sections are inclined sections inclined from an upstream side toward a downstream side, and an inclination angle of the inclined sections formed at the second step surface with respect to a radial direction of a rotary shaft is set to be larger than an inclined angle of the inclined section formed at the first step surface.

2. A turbine comprising:

a blade;

a structure installed at a tip section side of the blade via a gap and configured to relatively rotate with respect to the blade;

a step section formed at one of sections, the tip section of the blade and a section of the structure opposite to the tip section, protruding toward the other sections such that protrusion heights are gradually increased from an upstream side toward a downstream side of the step section, and having a first step surface and a second step surface which is provided on a downstream side of the first step surface;

a seal fin formed at the other of sections, the tip section of the blade and a section of the structure opposite to the tip section, extending toward the step section, and configured to form a micro gap between the step section and the seal fin; and a cutout section formed at each of the first step surface and the second step surface to be connected to an upper surface of the step section, wherein a fluid flows through the gap, the cutout sections guide a separation vortex separated from a main stream of the fluid toward the seal fin on the upper surface of the step section, the cutout sections each have an arc-shaped section smoothly connected to the upper surface from the upstream side toward the downstream side, and an angle between a tangential direction of a portion of the arc-shaped section formed at the second step surface connected to the upper surface and a radial direction of a rotary shaft is set to be larger than an angle between a tangential direction of a portion of the arc-shaped section formed at the first step surface.

* * * * *